US006708827B2

(12) United States Patent
Schommarz

(10) Patent No.: US 6,708,827 B2
(45) Date of Patent: Mar. 23, 2004

(54) FLOTATION MACHINE AND METHOD FOR IMPROVING FLOTATION EFFECT

(75) Inventor: Klaus Schommarz, Pretoria (ZA)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/149,778

(22) PCT Filed: Dec. 13, 2000

(86) PCT No.: PCT/FI00/01090

§ 371 (c)(1),
(2), (4) Date: Sep. 25, 2000

(87) PCT Pub. No.: WO01/43881

PCT Pub. Date: Jun. 21, 2001

(65) Prior Publication Data

US 2003/0111394 A1 Jun. 19, 2003

(30) Foreign Application Priority Data

Dec. 14, 1999 (FI) ..... 992675

(51) Int. Cl.[7] ..... B03D 1/16
(52) U.S. Cl. ..... 209/169; 204/164
(58) Field of Search ..... 209/164, 169

(56) References Cited

U.S. PATENT DOCUMENTS 2,337,806 A * 12/1943 Fahrenwald ..... 209/169
4,750,994 A * 6/1988 Schneider ..... 209/170
4,964,576 A * 10/1990 Datta ..... 241/19
5,039,400 A 8/1991 Kallioinen et al.
5,096,572 A * 3/1992 Hwang ..... 209/164
5,472,094 A 12/1995 Szymocha et al.

OTHER PUBLICATIONS

Derwent's abstract, No. 85–215869/35, week 8535, Abstract of SU, 1138–192 A (Kuznt Coal Errichm), Feb. 7, 1985.

* cited by examiner

*Primary Examiner*—Thomas M. Lithgow
(74) *Attorney, Agent, or Firm*—Smith-Hill and Bedell

(57) ABSTRACT

The invention relates to a flotation machine and method for improving flotation effect in the flotation machine which is provided with members for feeding material to be treated in the flotation machine, members for removing the treated material out of the flotation machine at least in the upper part of the flotation machine and in the bottom part of the flotation machine, a mixing mechanism comprising a stator and a rotor located inside the machine, air supply means for supplying air to the mixing mechanism and forming a froth bed in the upper part of the flotation machine, at least one member for adjusting free space of the froth bed created in the flotation machine. According to the invention a conducting member is installed inside the flotation machine in order to add flowing material for slurry dilution in the slurry area essentially above the top art of the rotor, but below the froth zone.

15 Claims, 4 Drawing Sheets

FLOTATION MACHINE AND METHOD FOR IMPROVING FLOTATION EFFECT

Figure 1:
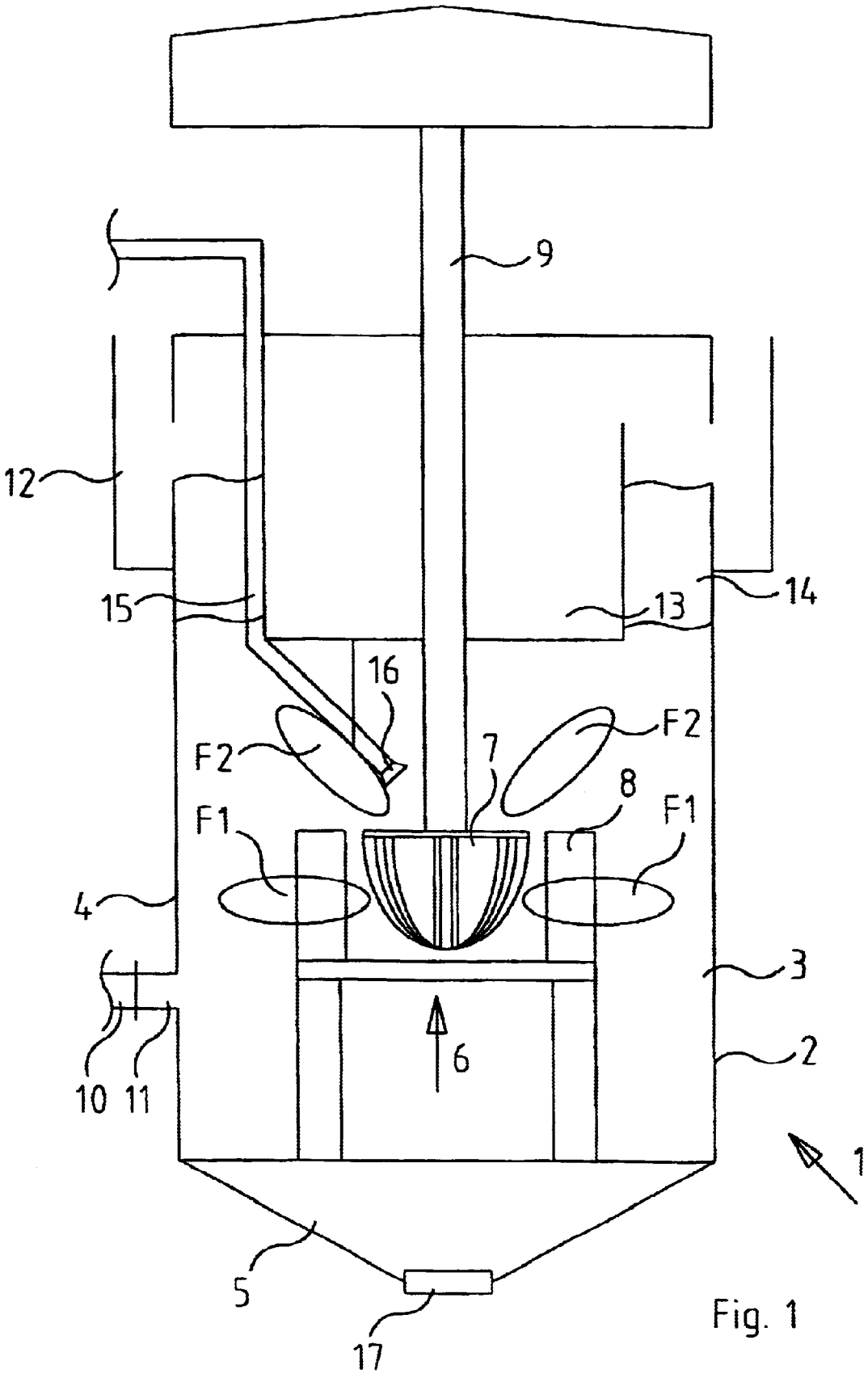

The invention relates to a flotation cell and a method for improving flotation effect in the flotation cell by feeding flowing material for slurry dilution to the top region of the cell below the froth zone.

In flotation machines, the desired valuable mineral particles are put to contact with air bubbles by means of chemicals. The air bubbles rise on the surface of the slurry layer and form a foam layer, the height whereof in free space is normally only 5% of the height between the bottom of the flotation machine and the foam outlet froth lip.

The U.S. Pat. No. 5,039,400 relates to a flotation machine where the slurry and froth space is provided with at least one downwards narrowing member, whereby the froth volume and the froth surface area can be regulated in order to form a thick froth bed. The height of this froth bed is between 20–40% of the total height of the flotation cell. Inside the froth bed, there is further arranged a washing system for cleaning the concentrate. Owing to the downward washing effect by the process liquid, the remaining small slime-forming particles both entrained between air bubbles and on the surfaces of the froth bubbles can be removed. By means of washing liquid, the slime-forming fine particles are settled to the slurry tank of the flotation cell and are advantageously discharged through the slurry outlet provided in the bottom part of the cell.

In this U.S. Pat. No. 5,039,400 the washing liquid, normally water, can be used also as dilution water for the slurry to be removed from the flotation machine via the bottom outlet. However, because washing liquid is fed into the froth bed, washing liquid will decrease the effect of the froth bed and thus the supply for the concentrate will be diminished, i.e. the recovery of the valuable mineral particles will be lower while the concentrate grade will increase.

The U.S. Pat. No. 5,923,012 describes a flotation method and apparatus for treatment of cyclone sands, where a flash flotation machine is provided with a top outlet for progressive removal of the surface froth from the upper zone via a launder to provide flotation concentrate, a bottom outlet for progressive withdrawal of the relatively dense component of the slurry from the lower zone and a side outlet for proggressive removal of the relatively less dense component of the slurry from the intermediate zone in the tank.

The dilution water in the U.S. Pat. No. 5,923,012 is fed to the flotation machine through the feed chute where from also the slurry to be concentrated is fed. The dilution water is then dispersed throughout the flotation machine. However, the main effect is directed to the pumping flows of the rotor in the lower part of the flotation machine. Thus for instance the intermediate zone of the flotation zone is not very effective as a target for the dilution water and, therefore, the slurry density in the slurry removed from the flotation machine can essentially be changed and is not advantageously maintained for further downstream treatment.

The object of the present invention is to eliminate at least some drawbacks of the prior art and to achieve a flotation machine and a method for improving flotation effect where flowing material for slurry dilution, as dilution water, is fed into a flotation machine below the froth bed, but essentially above the top part of the rotor of the flotation machine positioned in the lower part of the flotation machine. The essential features of the invention is enlisted in the enclosed claims.

In accordance with the invention, the flotation machine has members for feeding material to be treated in the flotation machine, members for removing the treated material out of the flotation machine at least in the upper part of the machine and in the bottom part of the flotation machine and a mixing mechanism comprising a stator and a rotor located inside the cell and beneath the feeding of the material. In the flotation machine there are also air supply means for supplying air to the mixing mechanism and forming a froth bed in the upper part of the flotation machine as well as members for adjusting the free space of the froth bed created in the flotation machine. In the upper part of the flotation machine for adjusting the slurry and the froth space there is at least one downwards narrowing, advantageously conical or wedge-shaped member. In accordance with the invention dilution water is fed below the froth zone, but essentially above the top part of the rotor of the flotation machine, by installing at least one conducting member for the dilution water inside the flotation machine.

The flowing material for slurry dilution in accordance with the invention can be liquid, as water, or diluted slurry in which the solids content is advantageously smaller than in the slurry already in the flotation machine. Further, the flowing material for slurry dilution can also be an overflow received for instance from a thickener.

The conducting member for the dilution member is for instance a pipe which is installed inside the tank of the flotation machine so that the conducting member is supported by the wall of the tank or by the adjusting member for the slurry and the froth space. It is also possible to install the conducting member so that the conducting member is supported by the stator of the flotation machine or by any other suitable surface inside the tank of flotation machine. The conducting member can also be installed in the froth zone. Regardless of the supporting surface the conducting member is installed so that the flowing material for slurry dilution, as dilution water, is directed into the slurry essentially above the top part of the rotor of the flotation machine, but below the froth zone.

In one embodiment for the dilution water to be fed into the flotation machine in accordance with the invention at least one adjusting member for the slurry and the froth space is provided with means to direct the dilution water to the area beneath the froth bed. The means is advantageously at least one conducting member which is installed to the outer surface of the adjusting member and the dilution water flows through the conducting member and is directed into the slurry. The dilution water can also be fed to the flotation machine by at least one conducting member which is installed inside the adjusting member. An opening is formed in the adjusting member in order to allow only the end part of the conducting member to be placed outside of the adjusting member. In accordance with one embodiment of the invention the conical part of the adjusting member operates as a vessel where from the dilution water is fed to the slurry positioned in the end part of the cone placed inside the slurry. Advantageously in any embodiments of the invention at least one nozzle is installed in that end of the conducting member which end is immersed in the slurry.

When feeding the dilution water in accordance with the invention to the top of the rotor the dilution water is sucked out of the conducting member by rotor flows which are directed to the top part of the slurry area of the flotation machine. Because the dilution water is fed essentially directly to the area where the dilution water has the advantageous effect for further treatment of the material to be removed from the flotation machine, the amount of the dilution water is also diminished.

The diminished amount of the dilution water makes it possible to obtain a higher bottom outlet density for the non-flotatable material. It also allows the froth concentrate being removed from the upper zone to contain a higher proportion of valuable mineral. Because the dilution water is under the effect of the secondary rotor flows, the effect of the dilution water is diminished in the lower part of the flotation machine in the area of the primary rotor flows and thus the density for the non-flotatable material in the bottom outlet is still high and advantageous for further treatment. The result therefrom is a low density area in the top part, beneath the froth bed of the flotation machine.

The invention is described in more details in the following drawings wherein

Figure 2:
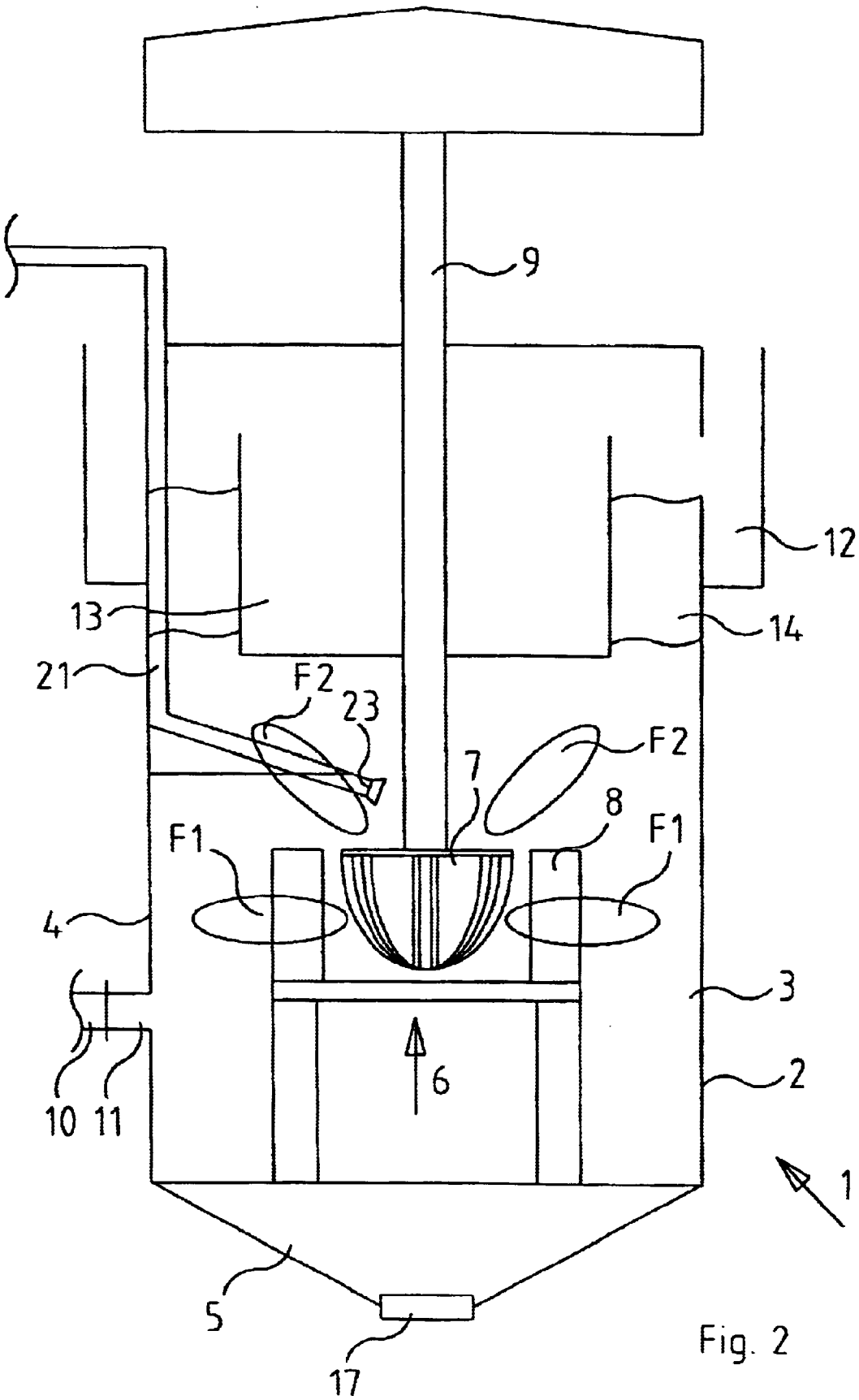
Figure 3:
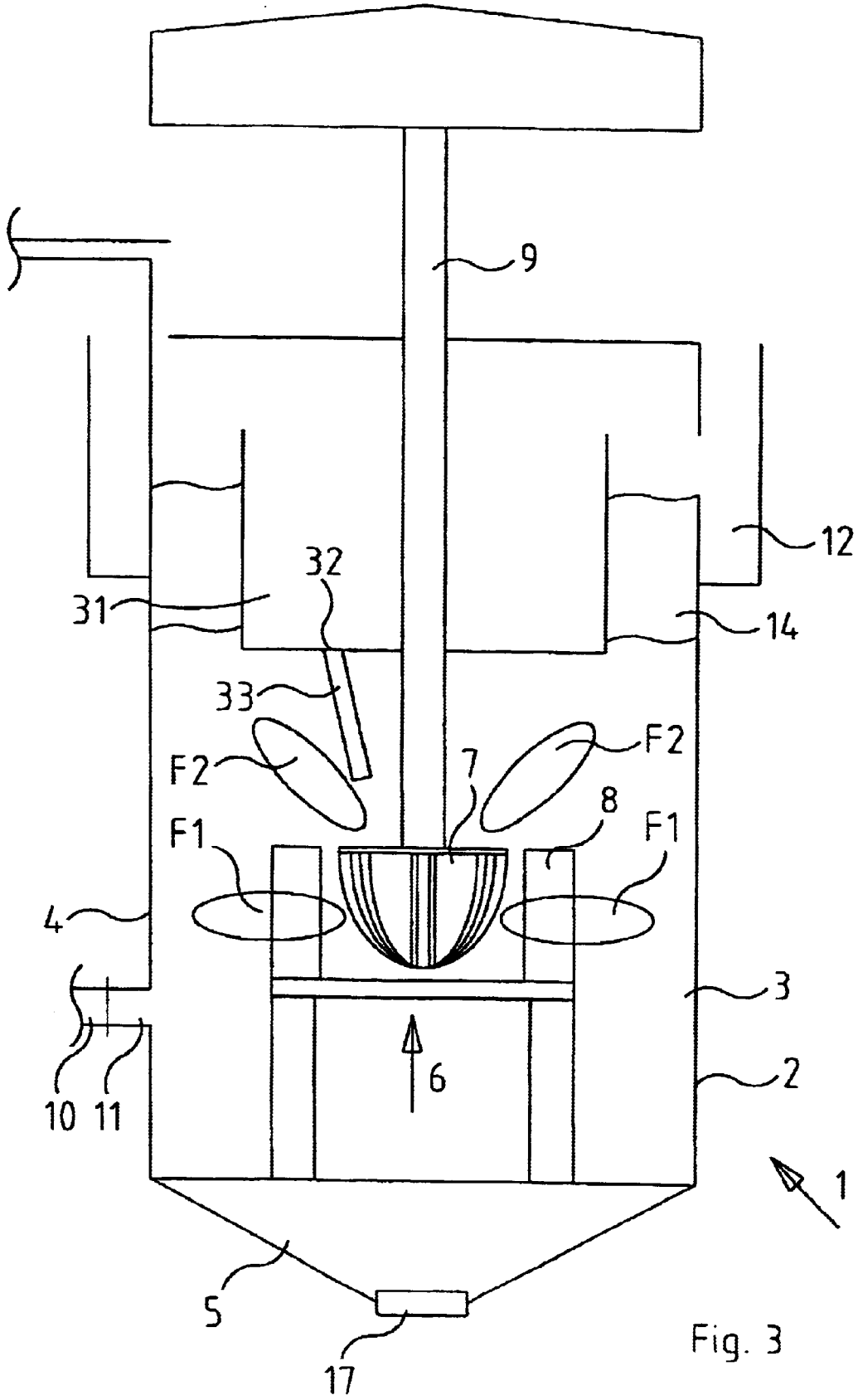
Figure 4:
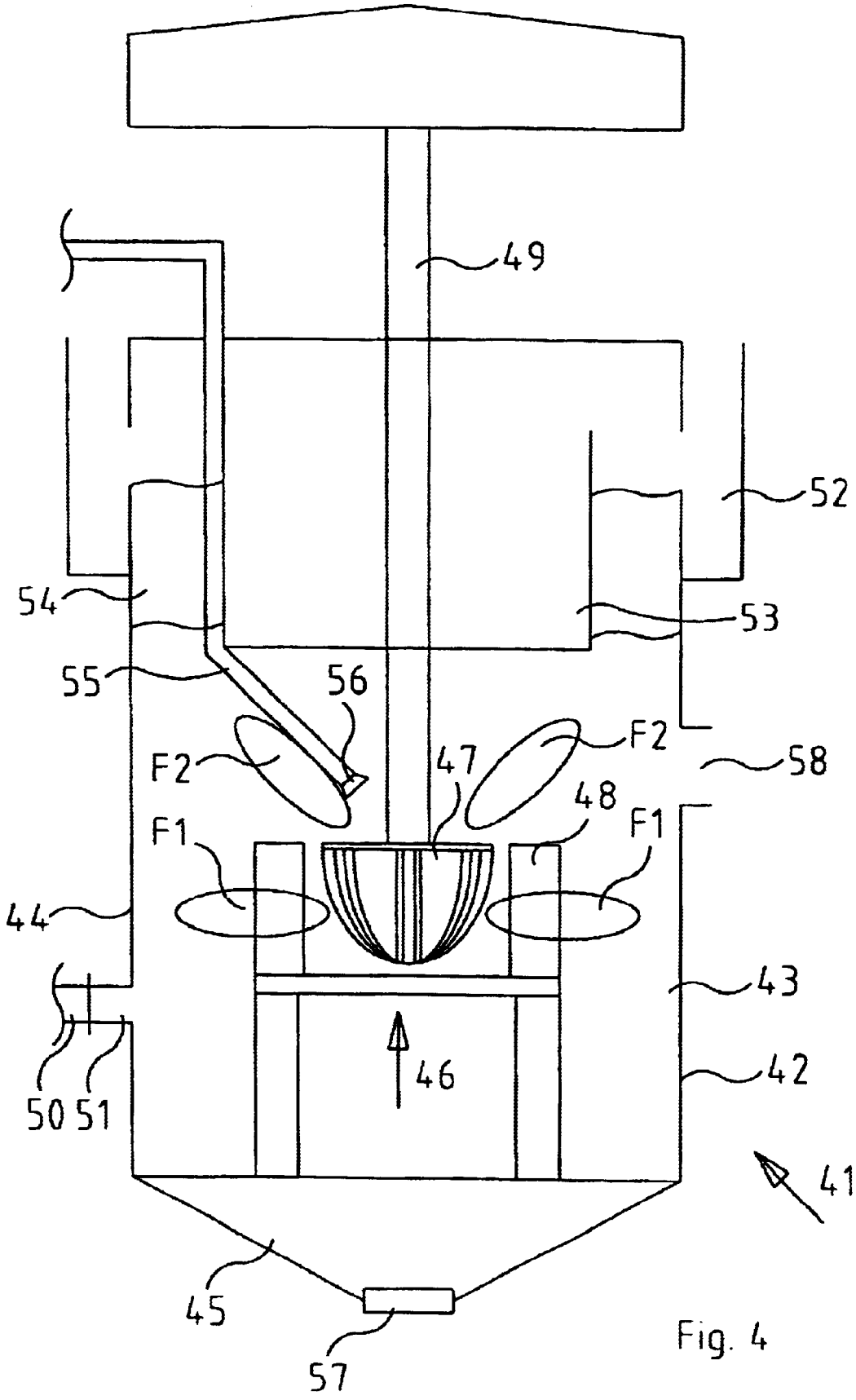

FIG. 1 illustrates one preferred embodiment of the invention as a schematic side-view, FIG. 2 illustrates another preferred embodiment of the invention as a schematic side-view, FIG. 3 illustrates further another preferred embodiment of the invention as schematic side-view, FIG. 4 illustrates still further another preferred embodiment of the invention as schematic sideview.

According to the FIG. 1, in a flotation cell 1 a tank 2 contains slurry 3 to be treated. The tank 2 is defined by side walls 4, a conical bottom section 5, and an open top. An agitation mechanism 6 containing a rotor 7 and a stator 8 is installed inside the tank 2. The rotor 7 is rotated by a drive shaft 9. In order to create a froth bed in the top part of the tank 2, air supply means is arranged in the tank 2 using the hollow drive shaft 9 wherethrough the air is brought to the rotor 7.

The slurry is fed through the pipe 10 to the inlet 11 positioned in the lower part of one side wall 4 of the tank 2. In the bottom section 5 of the tank 2 a bottom outlet 17 for non-flotatable material is placed. The froth 14 created in the tank 2 is overflowed via a froth lip 12 which is installed outside of the top part of the side walls 4. On the top part of the tank 2 there is also installed an adjusting member 13 for adjusting the free space of the froth 14 and the slurry 3. The adjusting member 13 is provided with a pipe 15 for dilution water installed on that surface of the adjusting member 13 which is in contact with the froth 14 and the slurry 3. The pipe 15 is so installed that the end of the pipe 15 which is positioned inside the tank 2 is close to the top part of the rotor 7. The pipe 15 is further provided with at least one nozzle 16 on that end which is positioned inside the tank 2.

When operating the flotation cell 1, the slurry 3 to be treated is fed from the inlet 11 and the rotor 7 is mixing and aerating the slurry 3. The rotor 7 causes in the slurry 3 at least two different flows; primary flows F1 and secondary flows F2 whereof the flows F1 have main effect in the vicinity of the rotor 7 and the stator 8. The flows F2 have main effect in the slurry 3 in the area between the rotor 7 and the froth 14 in the top part of the tank 2. The dilution water is fed through the pipe 15 into the slurry 3 in the area where the flows F2 have their main effect. The dilution water has thus influence with the area of the slurry 3 where the amount of the coarse and heavy particles is rather small because owing to the primary flows F1 those coarse and heavy particles are sucked to the bottom section 5 of the tank 2. Thus the dilution water has only small effect to the density of that material removed from the tank 2 through the bottom outlet 17. Besides, the dilution water will diminish the density of the slurry 3 near the boundary between the slurry 3 and the froth 14 in order to create a stable froth 14 which is easy to remove as an overflow from the top part of the tank 2.

The embodiment of FIG. 2 is different from the embodiment of FIG. 1 in that a pipe 21 for the dilution water to the top part of the rotor 7 is installed on the internal surface of the side wall 4 of the flotation cell 1. At least one nozzle 23 has been installed to the end of the pipe 21 in order to direct the dilution water in a desired manner.

According to the embodiment of FIG. 3 the adjusting member 31 operates in its inner part as a vessel for the dilution water. Therefore, in the lower part of the adjusting member 31 there are at least one opening 32 for dilution water. The opening 32 is provided with at least one nozzle in order to direct the dilution water. For better directing of the dilution water the opening 32 can also be provided with a conducting member 33 which has at least one nozzle in the end.

In FIG. 4 in a flotation cell 41, which has a substantially circular cross-section horizontally, a tank 42 contains slurry 43 to be treated. The tank 42 is defined by a side wall 44, a conical bottom section 45, and an open top. An agitation mechanism 46 containing a rotor 47 and a stator 48 is installed inside the tank 42. The rotor 47 is rotated by a drive shaft 49. In order to create a froth bed in the top part of the tank 42, air supply means is arranged in the tank 42 using the hollow drive shaft 49 wherethrough the air is brought to the rotor 47.

The slurry is fed through the pipe 50 to the inlet 51 positioned in the lower part of the side wall 44 of the tank 42. In the bottom section 45 of the tank 42 a bottom outlet 57 for non-flotatable material is placed. In the side wall 44 below the zone where the froth bed is created there is also a side outlet 58 for removal of the relatively less dense component of the slurry 43 from the intermediate zone in the tank 42. The froth 54 created in the tank 42 is overflowed via a froth lip 52 which is installed outside of the top part of the side wall 44. On the top part of the tank 42 there is also installed at least one adjusting member 53 for adjusting the free space of the froth 54 and the slurry 43. The adjusting member 53 is provided with a pipe 55 for dilution water installed on that surface of one adjusting member 53 which is in contact with the froth 54 and the slurry 43. The end of the pipe 55 which is positioned inside the tank 42 is installed substantially close to the upper part of the rotor 47. The pipe 55 is further provided with at least one nozzle 56 on that end which is positioned inside the tank 42.

When operating the flotation cell 41, the slurry 43 to be treated is fed from the inlet 41 and the rotor 47 is mixing and aerating the slurry 43. The rotor 47 causes in the slurry 43 at least two different flows; primary flows F1 and secondary flows F2 whereof the flows F1 have main effect in the vicinity of the rotor 47 and the stator 48. The flows F2 have main effect in the slurry 43 in the area between the rotor 47 and the froth 54 in the top part of the tank 42. The dilution water is fed through the pipe 55 into the slurry 43 close to the upper part of the rotor 47 in the area where the flows F2 have the main effect. The dilution water has thus influence with the area of the slurry 43 where the amount of the coarse and heavy particles is rather small because owing to the primary flows F1 those coarse and heavy particles are sucked to the bottom section 45 of the tank 42. Thus the dilution water has only small effect to the density of that material removed from the tank 42 through the bottom outlet 57 but the dilution water has much greater effect to the density of that material to be removed through the side outlet 58 and thus to the density of the material in the froth bed 54. This is because the dilution water will diminish the density of the slurry 43 near the boundary between the slurry 43 and the froth 54 in order to create a stable froth 54 which is easy to remove as an overflow from the top part of the tank 42.

EXAMPLE

In order to show the effectiveness of the invention in comparison with the prior art, tests were prepared in the flotation cell of the embodiment of FIG. 4 where part of the slurry was removed from an outlet positioned in the side wall of the flotation cell. The dilution water rate for the tests were 14 $m^3/h$. In accordance with the invention, the dilution water was added through the adjusting member, while in accordance with the prior art the dilution water was added through the feed chute of the slurry material to be treated in the flotation cell.

As a results from the tests the following values were achieved:

| Depth from froth lip | Invention % by weight solids | Prior art % by weight solids |
|---|---|---|
| 250 mm | 27.52 | 51.83 |
| 500 mm | 28.10 | 54.06 |
| 750 mm | 26.47 | 57.83 |
| 1000 mm | 28.20 | 71.44 |
| 1250 mm | 67.12 | 72.09 |
| 1500 mm | 69.38 | 72.66 |
| 1750 mm | 72.55 | 73.84 |

Owing to the low solid content the froth bed will be more stable than in the prior art and this will diminish fines to be circulated in the flotation circuit.

What is claimed is:

1. Flotation machine provided with members for feeding material (11, 51) to be treated in the flotation machine, members for removing the treated material out of the flotation machine at least in the upper part (12,52) of the flotation machine and in the bottom part (17,57) of the flotation machine, a mixing mechanism (16,46) comprising a stator (8,48) and a rotor (7,47) located inside the machine, air supply means (9,49) for supplying air to the mixing mechanism and forming a froth bed (14,54) in the upper part of the flotation machine, at least one member (13,53) for adjusting free space of the froth bed created in the flotation machine, characterised in that a conducting member (15,21,55) is installed inside the flotation machine in order to add flowing material for slurry dilution in the slurry area essentially above the top part of the rotor (7,47), but below the froth zone (14,54).

2. Flotation machine according to claim 1, characterised in that the conducting member (15,21,55) is installed on the outer surface of the adjusting member (13,53).

3. Flotation machine according to claim 1, characterised in that the conducting member (15,21,55) is installed inside the adjusting member (13,53).

4. Flotation machine according to claim 1, characterised in that the conducting member (15,55) is installed on the internal side wall (4,44) of the flotation machine (1,41).

5. Flotation machine according to claim 1, characterised in that the conducting member (15,55) is installed in the froth zone (14,54).

6. Flotation machine according to claim 1, characterised in that the adjusting member (13,43) is an adding vessel for water to be added.

7. Method for improving flotation effect in the flotation machine according to the claim 1 provided with members (11,51) for feeding material to be treated in the flotation machine, members for removing the treated material out of the flotation machine at least in the upper part (12,52) of the flotation machine and in the bottom part (17,47) of the flotation machine, a mixing mechanism (6,46) comprising a stator (8,48) and a rotor (7,47) located inside the machine, air supply means (9,49) for supplying air to the mixing mechanism and forming a froth bed (14,54) in the upper part of the flotation machine, at least one member (13,53) for adjusting free space of the froth bed (14,54) created in the flotation machine, characterised in that flowing material for slurry dilution into the flotation machine (1,41) is fed into the slurry area above the top part of the rotor (7,47) by a conducting member (15,21,55) installed inside the flotation machine (1,41).

8. Method according to claim 7, characterised in that flowing material for slurry dilution to be fed is conducted through a conducting member (15,21,55) connected to the adjusting member (13,53).

9. Method according to claim 7, characterised in that flowing material for slurry dilution to be fed is conducted through a conducting member (15,21,55) connected to the internal surface of the side wall (4,44) of the flotation machine (1,41).

10. Method according to claim 7, characterised in that the adjusting member (13,53) is used as an adding vessel for flowing material for slurry dilution to be fed.

11. Method according to claim 7, characterized in that flowing material for slurry dilution to be fed is conducted through a conducting member connected to the outer surface of the adjusting member.

12. Method according to claim 7, characterized in that flowing material for slurry dilution to be fed is conducted through a conducting member connected to the inner surface of adjusting member.

13. Method according to claim 7, characterized in that flowing material for slurry dilution is water.

14. Method according to claim 7, characterized in that flowing material for slurry dilution is slurry.

15. Method according to claim 7, characterized in that flowing material for slurry dilution is an overflow of a thickener.

* * * * *